US011331703B2

(12) United States Patent
Hidaka et al.

(10) Patent No.: US 11,331,703 B2
(45) Date of Patent: May 17, 2022

(54) PIERCER PLUG AND METHOD OF MANUFACTURING THE SAME

(71) Applicant: Nippon Steel & Sumitomo Metal Corporation, Tokyo (JP)

(72) Inventors: Yasuyoshi Hidaka, Tokyo (JP); Yasuto Higashida, Tokyo (JP); Yuichi Yamanari, Tokyo (JP); Yuji Yamamoto, Tokyo (JP); Tatsuya Miyai, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 326 days.

(21) Appl. No.: 15/762,821

(22) PCT Filed: Aug. 12, 2016

(86) PCT No.: PCT/JP2016/073706
§ 371 (c)(1),
(2) Date: Mar. 23, 2018

(87) PCT Pub. No.: WO2017/051632
PCT Pub. Date: Mar. 30, 2017

(65) Prior Publication Data

US 2018/0354008 A1 Dec. 13, 2018

(30) Foreign Application Priority Data

Sep. 25, 2015 (JP) ..... 2015-188403
Oct. 6, 2015 (JP) ..... JP2015-198103
Jul. 27, 2016 (JP) ..... 2016-147027

(51) Int. Cl.
*B21B 25/00* (2006.01)
*C22C 38/04* (2006.01)
(Continued)

(52) U.S. Cl.
CPC ..... *B21B 25/00* (2013.01); *C21D 6/004* (2013.01); *C21D 6/005* (2013.01); *C21D 6/007* (2013.01);
(Continued)

(58) Field of Classification Search
CPC ..... B21B 19/00; B21B 19/04; B21B 25/00; B21B 25/02; C21D 8/0294; C21D 2221/00; C21D 2221/01
See application file for complete search history.

(56) References Cited

U.S. PATENT DOCUMENTS 3,655,244 A * 4/1972 Swisher ..... B25D 17/02 299/113
4,393,677 A * 7/1983 Tamura ..... B21B 25/00 72/209
(Continued)

FOREIGN PATENT DOCUMENTS

EP 2404680 A1 1/2012
GB 1441052 A 6/1976
(Continued)

*Primary Examiner* — Gregory D Swiatocha
*Assistant Examiner* — Bobby Yeonjin Kim
(74) *Attorney, Agent, or Firm* — Banner & Witcoff, Ltd.

(57) ABSTRACT

A piercer plug with increased life and a method of manufacturing it are provided. The piercer plug 1 includes a tip portion 2 and a trunk portion 3 made of the same material as the tip portion 2 and continuous to the tip portion 2. The trunk portion 3 includes a cylindrical portion 5 having a hole used for attaching a bar. The tip portion 2 is harder than the cylindrical portion 5.

1 Claim, 5 Drawing Sheets

(51) Int. Cl.

| | |
|---|---|
| ***C21D 6/00*** | (2006.01) |
| ***C21D 9/00*** | (2006.01) |
| ***C22C 38/00*** | (2006.01) |
| ***C22C 38/02*** | (2006.01) |
| ***C22C 38/42*** | (2006.01) |
| ***C22C 38/44*** | (2006.01) |
| ***C22C 38/52*** | (2006.01) |
| ***C22C 38/54*** | (2006.01) |

(52) U.S. Cl.

CPC ..... *C21D 6/008* (2013.01); *C21D 9/0068* (2013.01); *C22C 38/002* (2013.01); *C22C 38/02* (2013.01); *C22C 38/04* (2013.01); *C22C 38/42* (2013.01); *C22C 38/44* (2013.01); *C22C 38/52* (2013.01); *C21D 9/00* (2013.01); *C21D 2211/001* (2013.01); *C22C 38/00* (2013.01); *C22C 38/54* (2013.01)

(56) References Cited

U.S. PATENT DOCUMENTS

| | | | | |
|---|---|---|---|---|
| 5,031,434 | A * | 7/1991 | Takase | B21B 25/00 72/209 |
| 8,065,900 | B2 * | 11/2011 | Hidaka | C23C 8/14 72/342.2 |
| 2004/0154705 | A1 * | 8/2004 | Friederich | C23C 8/80 148/567 |
| 2010/0050723 | A1 * | 3/2010 | Hidaka | B21B 25/00 72/97 |
| 2012/0210761 | A1 * | 8/2012 | Higashida | B21B 25/00 72/43 |
| 2013/0302109 | A1 * | 11/2013 | Pinzl | C23C 8/26 148/222 |
| 2014/0017509 | A1 * | 1/2014 | Takahashi | B32B 15/04 428/593 |
| 2015/0217349 | A1 * | 8/2015 | Iguchi | C25D 7/00 72/209 |

FOREIGN PATENT DOCUMENTS

| | | | | |
|---|---|---|---|---|
| JP | S62244505 | A | 10/1987 | |
| JP | H0318901 | U | 2/1991 | |
| JP | H0585242 | B2 | 12/1993 | |
| JP | H0796305 | A | 4/1995 | |
| JP | 2683861 | B2 | 12/1997 | |
| JP | H10156410 | A | 6/1998 | |
| JP | H10291008 | A | 11/1998 | |
| JP | 2003171733 | A | 6/2003 | |
| JP | 3635531 | B2 | 4/2005 | |
| JP | 2005336567 | A | 12/2005 | |
| JP | 4279350 | B1 | 6/2009 | |
| JP | 5169982 | B2 | 3/2013 | |
| JP | 2013248619 | A | 12/2013 | |
| JP | 5464300 | B1 | 4/2014 | |
| JP | 5566417 | B2 * | 8/2014 | C23C 4/06 |

* cited by examiner

FIG. 3
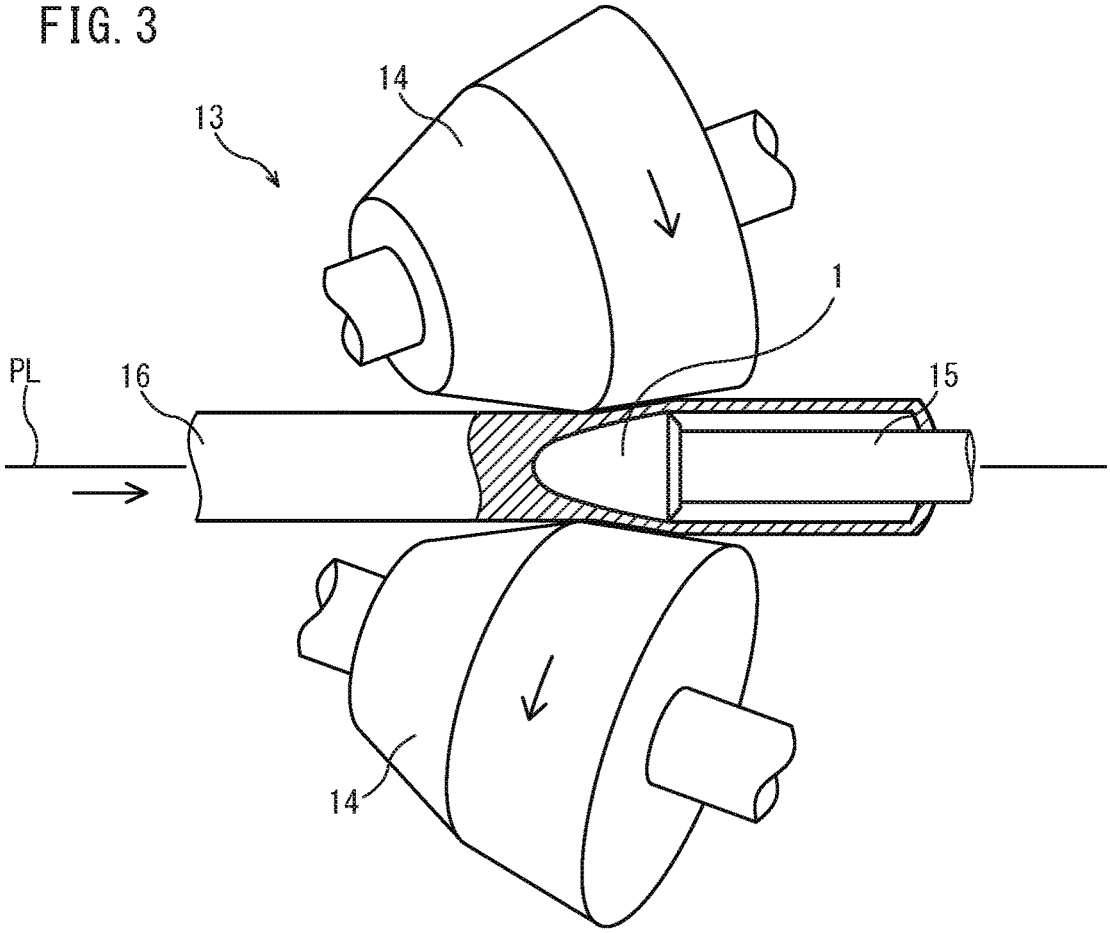
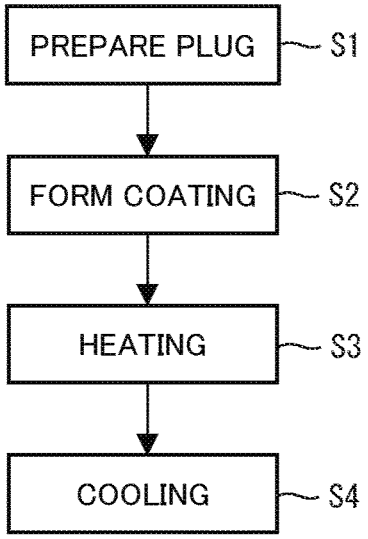
FIG. 4

PIERCER PLUG AND METHOD OF MANUFACTURING THE SAME

RELATED APPLICATION DATA

This application is a National Stage Application under 35 U.S.C. 371 of co-pending PCT application number PCT/JP2016/073706 designating the United States and filed Aug. 12, 2016; which claims the benefit of JP application number 2016-147027 and filed Jul. 27, 2016; JP application number 2015-198103 and filed Oct. 6, 2015; and JP application number 2015-188403 and filed Sep. 25, 2015 each of which are hereby incorporated by reference in their entireties.

TECHNICAL FIELD

The present invention relates to a piercer plug and a method of manufacturing the same, and more particularly, to a piercer plug used for piercing/rolling to produce a seamless steel pipe, and a method of manufacturing the same.

BACKGROUND ART

Seamless steel pipes are manufactured by using a piercing/rolling mill (or piercer) to perform piercing/rolling on a heated billet. Japanese Unexamined Patent Application Publication No. H07(1995)-96305 A and Japanese Utility Model Application Publication No. H03(1991)-18901 A each disclose a piercer plug used for piercing/rolling. Piercer plugs are used in an extremely harsh environment.

Japanese Unexamined Patent Application Publication No. 2003-171733 A, Japanese Unexamined Patent Application Publication No. H10(1998)-291008 A, Japanese Patent No. 2683861 and Japanese Patent No. 3635531 each disclose a piercer plug having an oxide coating on the material surface to reduce wear of the material. Japanese Unexamined Patent Application Publication No. 2013-248619 A, Japanese Patent No. 4279350 and Japanese Patent No. 5169982 each disclose a piercer plug having a sprayed coating on the material surface to reduce wear of the material. When used for piercing, all of these coatings wear off due to abrasion and peeling. When the coating of a piercer plug has been worn out, the use of the piercer plug may be interrupted and a coating may be formed once again to allow the piercer plug to be reused. However, when the amounts of deformation and wear of the plug base material (or simply material) caused by piercing/rolling exceed permissive levels, the plug cannot be reused. Deformation and wear (hereinafter collectively referred to as deformation) of a piercer plug used for piercing/rolling tend to occur especially at its tip portion.

Japanese Patent No. 5464300 discloses a piercer plug having a build-up layer on the tip portion and a sprayed coating located rearward of the build-up layer. This piercer plug reduces deformation of the plug base material (or simply material) by means of a high-strength build-up layer. Japanese Unexamined Patent Application Publication No. H10(1998)-156410 A discloses a piercer plug in which the trunk portion is formed from a 3Cr-1Ni-based low-alloy steel (Cr for chromium and Ni for nickel) and the tip portion is formed from an Nb (niobium) alloy to increase the high-temperature strength of the tip portion to reduce deformation of the tip portion. Japanese Unexamined Patent Application Publication No. H05(1993)-85242 discloses a piercer plug having a tip portion formed from a heat-resistant alloy and a body on which the tip portion is mounted such that they are rotatable relative to each other to prevent deformation.

DISCLOSURE OF THE INVENTION

As has been demonstrated by the above, it has not been uncommon to increase the hardness of the surface of the tip portion of a piercer plug to reduce deformation of the piercer plug. However, piercer plugs that have been proposed are constructed by forming a build-up layer on the tip portion or by attaching, to the trunk portion, a tip portion made from a material different from that of the trunk portion, leading to complicated manufacture processes and also increased manufacture costs.

Meanwhile, the entire piercer plug may be made of a hard material, in which case the toughness of the material is low, potentially causing cracking during piercing/rolling. Regarding this, the present inventors observed exactly how cracking occurs in plugs and found that cracking during piercing/rolling mainly initiates at a joining hole provided on the piercer plug to join the piercer plug with a bar (i.e. mandrel).

An object of the present invention is to provide a piercer plug having tip and trunk portions made of the same material, where deformation of the piercer plug is prevented and cracking is prevented, thereby achieving a longer life, and a method of manufacturing such a plug.

A piercer plug according to an embodiment of the present invention includes: a tip portion; and a trunk portion made of the same material as the tip portion and continuous to the tip portion. The trunk portion includes a cylindrical portion having a hole used for attaching a bar. The tip portion is harder than the cylindrical portion.

A method of manufacturing a piercer plug according to an embodiment of the present invention includes: preparing a piercer plug including a tip portion and a trunk portion made of the same material as the tip portion and continuous to the tip portion; and heating the piercer plug such that a temperature of the tip portion is not lower than an austenite transformation temperature and a temperature of a cylindrical portion included in the trunk portion and having a hole used for attaching a bar is lower than the austenite transformation temperature.

The present invention increases the life of the piercer plug.

BRIEF DESCRIPTION OF THE DRAWINGS

FIG. 3 is a schematic view of a piercing/rolling mill including a piercer plug.

FIG. 4 is a flow chart of a manufacture method according to an embodiment of the present invention.

EMBODIMENTS FOR CARRYING OUT THE INVENTION

Figure 1:
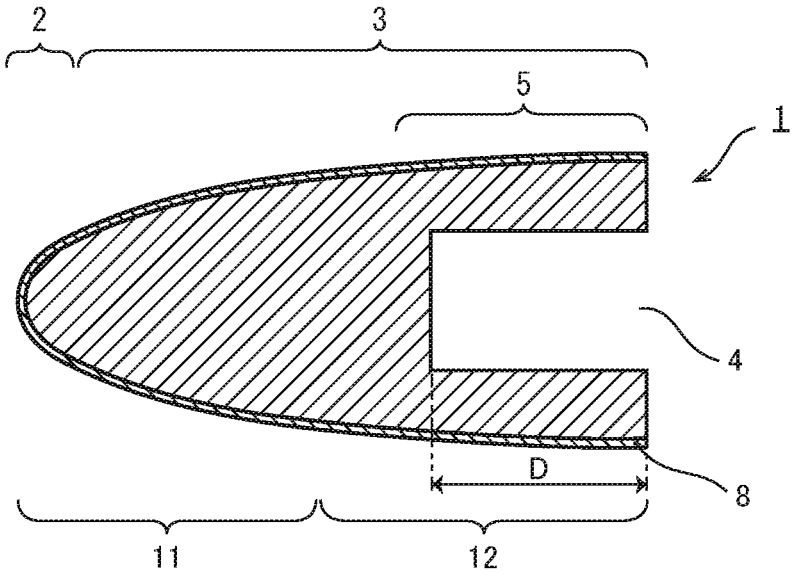
FIG. 1 is a vertical cross-sectional view of a piercer plug according to an embodiment of the present invention.

The summary of an embodiment of the present invention will be given. A piercer plug includes: a tip portion; and a trunk portion made of the same material as the tip portion and continuous to the tip portion. The trunk portion includes a cylindrical portion having a hole used for attaching a bar. The tip portion is harder than the cylindrical portion.

In this piercer plug, the tip portion has higher hardness than the cylindrical portion and the cylindrical portion has a higher toughness than the tip portion. Thus, when the piercer plug is used for piercing/rolling, deformation of the tip portion is prevented and cracking in the cylindrical portion is prevented. This will allow the piercer plug to be used for a larger number of rounds of piercing/rolling, meaning a longer life.

This piercer plug further includes a coating formed on the surface of the piercer plug.

A method of manufacturing a piercer plug includes: preparing a piercer plug including a tip portion and a trunk portion made of the same material as the tip portion and continuous to the tip portion; and heating the piercer plug such that a temperature of the tip portion is not lower than an austenite transformation temperature and a temperature of a cylindrical portion included in the trunk portion and having a hole used for attaching a bar is lower than the austenite transformation temperature.

In the piercer plug manufactured by this method, the tip portion has a higher hardness than the cylindrical portion and the cylindrical portion has a higher toughness than the tip portion. Thus, when the piercer plug is used for piercing/rolling, deformation of the tip portion is prevented and cracking in the cylindrical portion is prevented. This will allow the piercer plug to be used for a larger number of rounds of piercing/rolling, meaning a longer life.

The method of manufacturing a piercer plug further includes forming a coating on the surface of the piercer plug before the heating.

In the piercer plug manufactured by this method, the coating prevents deformation of the rolling portion.

[Piercer Plug]

A piercer plug according to an embodiment of the present invention will be described in detail below. The piercer plug (hereinafter simply referred to as plug) is repeatedly used in a piercing/rolling mill (or piercer) used to manufacture seamless steel pipes. The material used for the plug may be any steel whose hardness can be improved through heat treatment, that is, any hardenable steel. The plug is preferably formed through forging, but is not limited thereto.

The steel that provides a material for the plug preferably includes Fe (iron) and impurities and, in addition, characteristic elements in the ranges provided below. The steel may include other elements. In the following description, "%" relating to an element means mass %.

C: 0.08 to 0.5%

Carbon (C) is a component effective in improving high-temperature strength. C is ineffective if the C content is not higher than 0.08%. If the C content exceeds 0.5%, the hardness becomes too high. Also, it becomes difficult to control the conditions of precipitation of carbides. In view of this, the C content should be in the range of 0.08 to 0.5%. The C content is preferably not higher than 0.3%, and more preferably not higher than 0.2%. The C content is preferably not lower than 0.09%, and more preferably not lower than 0.1%.

Si: 0.1 to 1.0%

Silicon (Si) is a component effective in deoxidization. Si is substantially ineffective if the Si content is not higher than 0.1%. If the Si content exceeds 1.0%, the toughness of the material begins to deteriorate. In view of this, the Si content should be in the range of 0.1 to 1.0%. The Si content is preferably not higher than 0.9%, and more preferably not higher than 0.8%. The Si content is preferably not lower than 0.2%, and more preferably not lower than 0.3%.

Mn: 0.2 to 1.5%

Manganese (Mn) stabilizes austenite at high temperatures. That is, Mn prevents production of δ-ferrite and thus prevents decrease in toughness. The effects of Mn are present if the Mn content is not lower than 0.2%. However, if the Mn content exceeds 1.5%, the hardness becomes too high, and quench cracking is likely to occur after piercing. In view of this, Mn content should be in the range of 0.2 to 1.5%. The Mn content is preferably not higher than 1.4%, and more preferably not higher than 1.3%. The Mn content is preferably not lower than 0.3%, and more preferably not lower than 0.4%.

The material may contain one or more of the optional elements listed below. The material may contain none of the optional elements. The material may contain only one or some of them.

Ni: 0 to 2.0%

Nickel (Ni) is effective in improving the toughness of quenched phase formed in the surface layer of the plug. The material is substantially saturated in terms of Ni effectiveness when the Ni content is 2.0%. Adding more Ni means increased costs. In view of this, the Ni content should be in the range of 0 to 2.0%. The Ni content is preferably not higher than 1.9%, and more preferably not higher than 1.8%. The Ni content is preferably not lower than 0.2%, and more preferably not lower than 0.3%.

Mo: 0 to 4.0%; W: 0 to 4.0%

Molybdenum (Mo) and tungsten (W) are replaceable elements. These elements are effective in improving high-temperature strength, and increasing the $Ac_1$ point to reduce the hardened portions of the surface after piercing. However, if the total amount exceeds 8.0%, ferrite remains even at high temperatures, reducing strength and toughness. In view of this, the total amount should be not higher than 8.0%. The Mo content is preferably not higher than 3.9%, and more preferably not higher than 3.8%. The Mo content is preferably not lower than 0.75%, and more preferably not lower than 0.8%. The W content is preferably not higher than 3.9%, and more preferably not higher than 3.8%. The W content is preferably not lower than 0.75%, and more preferably not lower than 0.8%.

Cu: 0 to 0.5%

Copper (Cu) is an austenite stabilizing element, and effective in improving the toughness of the plug surface layer that has been held at high temperatures during piercing and become austenite. In view of this, the Cu content should be in the range of 0 to 0.5%.

B: 0 to 0.2%; Nb: 0 to 1.0%; V: 0 to 1.0%; Cr: 0 to 10.0%; Ti: 0 to 1.0%

If a slight amount of boron (B) is contained, it is effective in increasing the strength of grain boundaries. However, if the B content exceeds 0.2%, embrittled phase precipitates, deteriorating toughness. In view of this, the B content should be in the range of 0 to 0.2%. If slight amounts of niobium (Nb), vanadium (V), chromium (Cr) and titanium (Ti) are contained, they are effective in making crystal grains finer.

In view of this, each of the contents of Nb, V and Ti should be in the range of 0 to 1.0%, and the Cr content should be in the range of 0 to 10.0%.

In addition, for desulfurization or other purposes, small amounts of calcium (Ca) and rare earth elements (REMs) may be added to the material as necessary.

Figure 2:
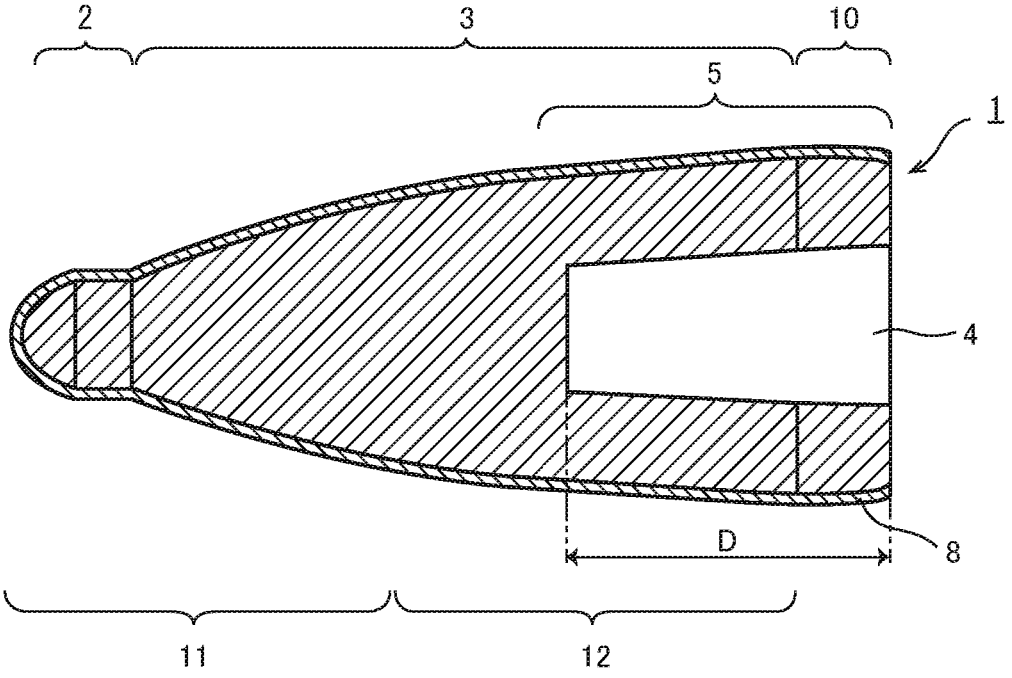
FIG. 2 is a vertical cross-sectional view of another piercer plug having a shape different from that of FIG. 1.

As shown in FIG. 1, the plug 1 may be projectile-shaped, for example. The plug 1 includes a tip portion 2 and a trunk portion 3. A transverse cross section of the plug 1 is circular in shape, as measured at both the tip portion 2 and trunk portion 3. The surfaces of the tip portion 2 and trunk portion 3 form a continuous face. The tip portion 2 and trunk portion 3 are formed from the same material and represent a single part. In the plug 1, the direction toward the tip portion 2 will be hereinafter referred to as toward the front/tip or forward, while the direction toward the trunk portion 3 will be referred to as rear(ward). The trunk portion 3 includes a joining hole 4 opening on the rear end surface (i.e. back face) provided for connection with a bar. The front end of the joining hole 4 (i.e. bottom of the hole) is located, for example, at the center of the entire length of the plug 1 (i.e. distance between the front end of the tip portion 2 and the rear end of the trunk portion 3) or rearward thereof. A rear portion of the plug 1 (i.e. rear portion of the trunk portion 3) is cylindrical in shape due to the presence of the joining hole 4. A portion of the plug 1 extending in the longitudinal direction (or axial direction) and having the joining hole 4 inside will be referred to as cylindrical portion 5. The front end of the cylindrical portion 5 is 0.1×D [mm] forward of the front end of the joining hole 4, where D [mm] is the distance between the front end of the joining hole 4 and the rear end thereof (i.e. opening end) as measured in the longitudinal direction of the plug 1, i.e. depth of the joining hole 4. That is, as measured in the longitudinal direction of the plug 1, the cylindrical portion 5 is the portion of the plug 1 located between the position 0.1×D [mm] forward of the front end of the joining hole 4 and the rear end of the plug 1. The plug 1 shown in FIG. 1 may further include a roll-off portion located rearward of the trunk portion 3. As shown in FIG. 2, the plug 1 may be shaped to have a tip portion 2 protruding in a convex manner. The plug 1 shown in FIG. 2 further includes a roll-off portion 10 located rearward of the trunk portion 3.

As shown in FIG. 3, the plug 1 is used in the piercing/rolling mill 13 for piercing/rolling, where the tip of a bar 15 (or mandrel) is attached to the joining hole 4. The plug 1 is positioned on a pass line PL between a pair of skewed rolls 14. During piercing/rolling, a solid billet 16 is pushed against the plug 1, starting with its tip portion 2; thus, the plug is exposed to high temperatures and receives high pressures.

From another viewpoint, as shown in FIGS. 1 and 2, the plug 1 is divided into a rolling portion 11 and a reeling portion 12. The rolling portion 11 is represented by the entire tip portion 2 and a front portion of the trunk portion 3 continuously connected to the tip portion 2, and the reeling portion 12 is the portion located rearward of the rolling portion 11 of the trunk portion 3. The rolling portion 11 receives a large part of the thickness rolling reduction during piercing/rolling. The reeling portion 12 finishes the wall thickness of a hollow shell (or simply shell) during piercing/rolling.

The plug 1 further includes a coating 8. The coating 8 is a sprayed coating mainly composed of iron and iron oxides formed by spraying or a scale coating formed by oxidation heat treatment, for example. The coating 8 is formed on the surface of the plug 1 and, for example, covers the entire plug surface (except for the rear end surface, on which the hole for joining the mandrel is provided). The coating 8 is only required to be present on at least the portion of the plug surface that is associated with the rolling portion 11, but preferably present on the entire surface except for the rear end surface of the plug. Preferably, the coating 8 has different thicknesses at different positions, and, preferably, the portion of the coating 8 on the surface of the tip portion 2 has a larger thickness than that of the portion of the coating 8 on the surface of the trunk portion 3.

The tip portion 2 is harder than the cylindrical portion 5. In the plug 1, the tip portion 2 has a Vickers hardness of 300 Hv or higher, while the cylindrical portion 5 preferably has a Vickers hardness of 220 to 260 Hv, but this may be not higher than 220 Hv. In the present embodiment, Vickers hardness is a value provided by measurement on a cross section of the plug 1 in the longitudinal direction based on JIS Z 2244 (2009) with a testing force of 1 kgf. In a Charpy impact test using a full-size test specimen based on JIS Z 2242 (2005), the cylindrical portion 5 has an impact value at 20° C. of 20 J/cm$^2$ or higher, which is about the same as in conventional plugs.

As has been demonstrated by the above, the plug 1 has a tip portion 2 with a higher hardness than the cylindrical portion 5 to prevent the tip portion 2 from being deformed by piercing/rolling. More specifically, in the plug 1, after being used for piercing/rolling, the amount of reduction in the total length due to deformation of the tip portion 2 (also referred to as amount of plug deformation) may be reduced to about 50% of conventional levels, for example. Further, the plug 1 is capable of piercing/rolling a billet with a piercing efficiency that is substantially equal to conventional levels.

If the cylindrical portion 5 had a hardness substantially equal to that of the tip portion 2, the toughness of the cylindrical portion 5 would be low such that cracking might occur in the cylindrical portion 5 due to piercing/rolling. In the plug 1 of the present embodiment, which includes a tip portion 2 and trunk portion 3 formed from the same material, only the tip portion 2 has a high hardness such that the plug includes a tip portion 2 with improved hardness and a cylindrical portion 5 having a desired toughness. This will make it possible to prevent deformation of the tip portion 2 of the plug 1 while preventing cracking in the cylindrical portion 5, thereby increasing the life of the plug when used repeatedly.

[Manufacture Method]

Now, a method of manufacturing a plug 1 according to an embodiment of the present invention will be described in detail. Discussions common to the description of the plug 1 will not be given again.

As shown in FIG. 4, the manufacture method includes, for example, a step S1 where a plug is prepared; a step S2 where a coating is formed on the plug; a step S3 where the plug is heated; and a step S4 where the plug is cooled. At step S1, the plug includes a tip portion 2 and a trunk portion 3. The tip and trunk portions 2 and 3 are formed from the same material. As such, in the plug prepared at step S1, the tip portion 2 and trunk portion 3 (or cylindrical portion 5) have the same hardness, and have the same toughness. The hardness of the plug prepared at step S1, as represented as a Vickers hardness, is preferably 220 to 260 Hv, but may be not higher than 220 Hv.

At step S2, a coating 8 is formed on the plug. The coating 8 may be formed by well-known methods. The coating 8 is preferably a sprayed coating formed by arc welding. For example, the coating 8 is a sprayed coating mainly composed of iron and iron oxides. Alternatively, step S2 may occur after step S3, or may occur after step S4, or may not occur at all. Step S2 may form, in lieu of a sprayed coating, a scale coating with oxidation heat treatment. The coating 8 is only required to be formed on at least the rolling portion 11, but preferably formed on the entire plug surface (except for the rear end surface). If the coating 8 is a sprayed coating, the coating is preferably formed before the heating of step S3.

Figure 5:
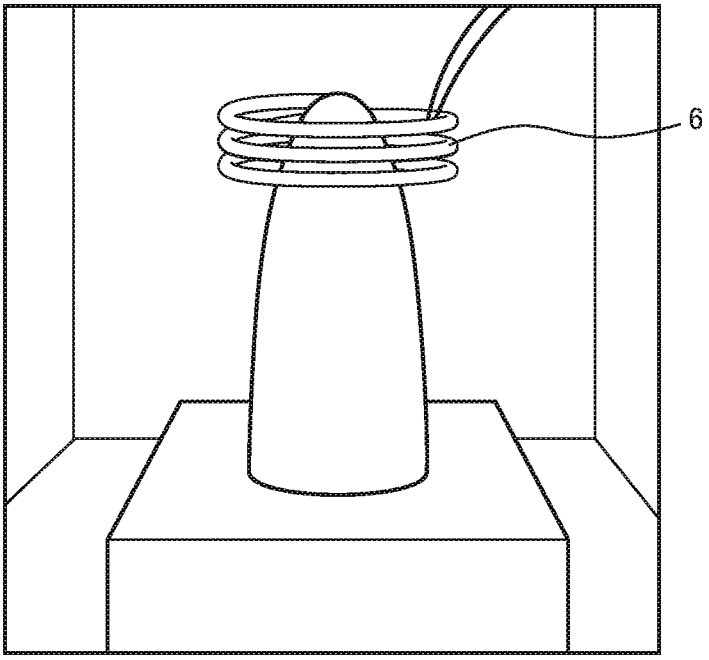
FIG. 5 is a schematic view of a heating apparatus.

At step S3, the tip portion 2 of the plug is heated. At step S3, the heating occurs in such a way that the temperature of the tip portion 2 is not lower than the austenite transformation temperature ($A_{C3}$ point) and the temperature of the cylindrical portion 5 is lower than the $A_{C3}$ point. As discussed above, the portion of the cylindrical portion 5 that is to be heated at a temperature lower than the $A_{C3}$ point is the portion located between the position 0.1×D [mm] forward of the front end of the joining hole 4 and the rear end of the plug. In other words, the portion located between the rear end of the plug and the position 0.1×D [mm] forward of the front end of the joining hole 4 is heated to a temperature lower than the $A_{C3}$ point. For the heating treatment, for example, as shown in FIG. 5, a high-frequency coil 6 is attached to the outer periphery of the tip portion 2, and the plug is placed in a heating apparatus containing an Ar atmosphere before the coil 6 is used to perform high-frequency heating on the tip portion 2 at a temperature of 1000 to 1200° C. The heating is only required to be done for a time sufficient to cause the portion to be hardened; if high-frequency heating is used, the heating only needs to be done for several seconds or longer at a temperature that is not lower than the $A_{C3}$ point; however, to achieve industrial stability, the heating time is preferably 20 seconds or longer, and more preferably one minute or longer. The heating time is preferably not longer than 20 minutes, and more preferably not longer than 10 minutes. Particularly, if the heating treatment is performed in an environment other than an inert gas atmosphere (for example, ambient air), the heating time is preferably not longer than 10 minutes, and more preferably not longer than 5 minutes, because heating for a prolonged period of time may change the nature of the sprayed coating 8. For example, in the ambient air, the coating 8 may be oxidized to an unacceptable degree. The heating treatment discussed above makes it possible to raise the temperature of the tip portion 2 to a level that is not lower than the $A_{C3}$ point and maintain the temperature of the cylindrical portion 5 below the $A_{C3}$ point. The apparatus for heating the plug is not limited to a high-frequency coil 6.

Figure 6:
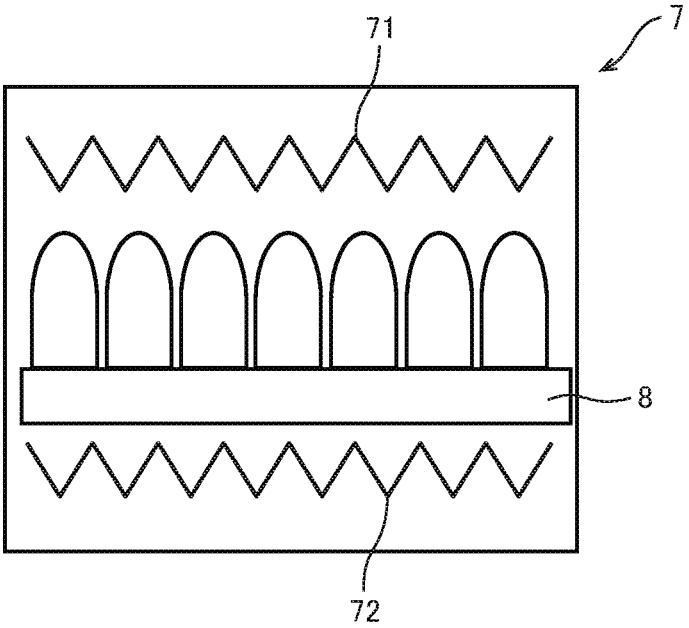
FIG. 6 is a schematic view of a heating apparatus different from the heating apparatus shown in FIG. 5.

FIG. 6 shows an example of an apparatus for heating the plug without the use of a high-frequency coil 6. The heating apparatus 7 shown in FIG. 6 includes heaters 71 and 72. The heater 71 is located adjacent the top of the heating apparatus 7. The heater 52 is located adjacent the bottom of the heating apparatus 7.

When step S3 is performed, the plug is loaded into the heating apparatus 7. Preferably, a plurality of plugs are loaded into the heating apparatus 7. A shield 8 is placed between the plugs and heater 72. That is, the shield 8 is located above the heater 72 and the plugs are mounted on the shield 8. The shield 8 reduces transmission of heat from the heater 72 to the plugs. The shield 8 may be shaped as a grid or a plate, for example. The shield 8 may be coated with an oxide.

The plugs in the heating apparatus 7 are heated by the heaters 71 and 72. The heaters 71 and 72 may operate at the same heating temperature (preset temperature). Preferably, the heating apparatus 7 contains an inert gas atmosphere such as Ar. When the temperature of the tip portion 2 of the plug has reached a predetermined temperature that is not lower than the $A_{C3}$ point, the plugs are removed from the heating apparatus 7. Since the shield 8 causes the amount of heat transmitted to the lower portion of each plug to be smaller than the amount of heat transmitted to the upper portion of the plug, the temperature of the cylindrical portion 5 is lower than the temperature of the tip portion 2. At the time point when the plug is removed from the heating apparatus 7, the temperature of the cylindrical portion 5 has not reached the $A_{C3}$ point and is below the $A_{C3}$ point.

The plug may be heated by the heating apparatus 7 without the shield 8. If this is the case, the heating temperature of the heater 72 located below the plugs is adjusted to be lower than the heating temperature of the heater 71 located above the plugs. This ensures that the amount of heat transmitted to the upper portion of each plug is relatively large and the amount of heat transmitted to the lower portion of the plug is relatively small. Thus, as is the case with the method using the shield 8, the plug may be heated such that the temperature of the tip portion 2 becomes not lower than the $A_{C3}$ point and the temperature of the cylindrical portion 5 is below the $A_{C3}$ point.

A thermocouple may be attached to each of the tip portion 2 and cylindrical portion 5 of each plug in the heating apparatus 7, for example, to measure the temperature of the associated one of the tip portion 2 and cylindrical portion 5. This makes it possible to detect that the temperature of the tip portion 2 has reached a predetermined temperature that is not lower than the $A_{C3}$ point while the temperature of the cylindrical portion 5 is below the $A_{C3}$ point, and remove the plug from the heating apparatus 7 at a suitable moment. The temperatures of the tip portion 2 and cylindrical portion 5 need not be measured each time step S3 is performed. An appropriate heating time can be learned by performing the temperature measurement once, and this heating time can be used for plugs of the same type to perform step S3.

At step S4, the plug which has been heated at step S3 is cooled. For example, the power supply to the coil 6 is stopped and the door of the heating apparatus is opened to cool the plug to a temperature not higher than 400° C., typically to room temperature. The plug 1 is produced in this manner. The cooling rate is only required to be sufficient to cause the plug to be hardened, and the plug may be left to cool or cooled at a higher rate.

As has been demonstrated by the above, in the plug 1 produced by this manufacture method, the tip portion 2 is heated to a temperature not lower than the $A_{C3}$ point to improve the hardness of the tip portion 2. Further, in the plug 1, the decrease in the toughness of the cylindrical portion 5 due to heating can be reduced by reducing the temperature of the cylindrical portion 5 to below the $A_{C3}$ point. As a result, the plug 1 includes a tip portion 2 with improved hardness and a cylindrical portion 5 having a desired toughness, thereby increasing its life. Further, it is possible to prevent the peeling of the coating 8, which would occur due to deformation of the tip portion 2 when the plug is used for piercing/rolling.

The manufacture of the plug 1 is not limited to the above-described method. Only the cylindrical portion 5 may be tempered to produce a plug 1 with a tip portion 2 having a higher hardness than the cylindrical portion 5. For example, a plug may be prepared where the entire plug (i.e. tip portion 2 and trunk portion 3) has a Vickers hardness of 300 Hv or higher, and only the cylindrical portion 5 may be tempered to produce a plug 1 with a tip portion 2 having a Vickers hardness of 300 Hv or higher and a cylindrical portion 5 having a Vickers hardness of 220 to 260 Hv.

EXAMPLES

A plurality of plugs were produced from a steel having the chemical composition shown in Table 1. These plugs were labeled Plug Nos. 1 to 16. In table 1, the content of each element is in mass %. Further, the balance in the chemical composition is Fe and impurities.

TABLE 1

| C | Si | Mn | P | S | Cu | Ni | Cr | Mo | Co | W |
|---|---|---|---|---|---|---|---|---|---|---|
| 0.15 | 0.50 | 0.50 | 0.008 | 0.004 | 0.01 | 1.0 | 0.5 | 1.40 | <0.01 | 3.50 |

Figure 7:
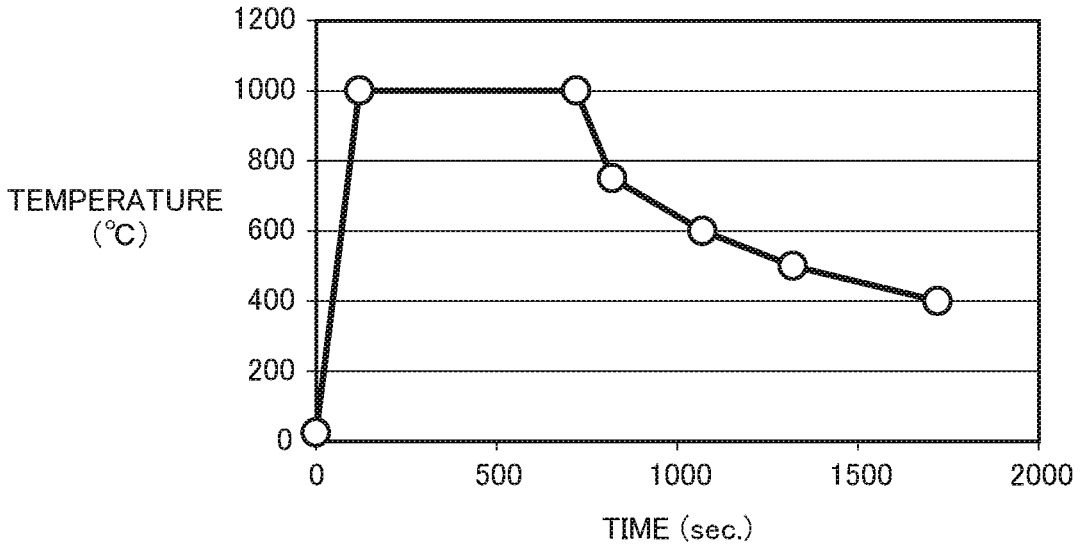
FIG. 7 is a graph showing an example of a heat pattern.

In each of Plug Nos. 1 to 17, a coating 8 was formed on the tip portion 2 and trunk portion 3. The coating 8 was a sprayed coating produced by arc welding using iron wire (wire of common steel). For each of Nos 1 to 15, the plug including the coating 8 was heated by the heating apparatus shown in FIG. 5, and the power supply to the coil 6 was then stopped and the door of the heating apparatus was opened to leave the plug to cool, thereby producing a plug 1. The heating times and heating temperatures by the heating apparatus for Nos. 1 to 15 are shown in Table 2. The heat pattern at the tip portion 2 of Plug No. 1 is shown in FIG. 7. More specifically, Plug No. 1 was heated by the coil 6 to 1000° C. in 120 seconds before it was held at 1000° C. for 600 seconds. Thereafter, the plug was cooled from 1000° C. to 750° C. in 100 seconds, cooled from 750° C. to 600° C. in 250 seconds, cooled from 600° C. to 500° C. in 250 seconds, and cooled from 500° C. to 400° C. in 400 seconds. The plug 1 labeled No. 16 is a comparative example that has not been heated. In Table 2, the entries for heating temperature and heating time for No. 16 have "–", meaning the plug was not heated. The plug 1 labeled No. 17 is a comparative example that was subjected to heat treatment by a coil capable of heating the entire plug. The heating temperature and heating time for No. 17 were 1200° C. and 1200 seconds, as shown in Table 2.

TABLE 2

| No. | Heating temp. (° C.) | Heating time (sec.) |
|---|---|---|
| 1 | 1000 | 600 |
| 2 | 1000 | 1200 |
| 3 | 1000 | 1800 |
| 4 | 1000 | 3600 |
| 5 | 1000 | 7200 |
| 6 | 1100 | 600 |
| 7 | 1100 | 1200 |
| 8 | 1100 | 1800 |
| 9 | 1100 | 3600 |
| 10 | 1100 | 7200 |
| 11 | 1200 | 600 |
| 12 | 1200 | 1200 |
| 13 | 1200 | 1800 |
| 14 | 1200 | 3600 |
| 15 | 1200 | 7200 |
| 16 | — | — |
| 17 | 1200 | 1200 |

[Piercing/Rolling Test]

The plugs 1 labeled Nos. 1 to 3 were selected from among the plugs 1 labeled Nos. 1 to 15, which are inventive examples; they and the plug 1 labeled No. 16, a comparative example, were used to conduct five rounds of testing in which piercing/rolling was performed on a billet made of SUS 304, and the amount of plug deformation was measured each time one round of piercing/rolling was completed. In other words, each plug was used repeatedly, five times, for piercing/rolling testing, and the amount of deformation was measured for each round. Also, the trunk portion 3 of the plug 1, particularly the cylindrical portion 5, was observed to see whether there was cracking. Billets with the same chemical composition were used for all tests.

[Observation of Deformation of Plug and Peeling of Coating]

The plugs 1 labeled Nos. 1 and 16 used five times for piercing/rolling testing were cut along the axial direction (i.e. longitudinal direction) and the cut surfaces were observed to determine the deformation of the tip portion 2 and the peeling of the coating 8.

[Hardness Test]

Vickers hardness was measured on the cut surfaces of the tip and cylindrical portions 2 and 5 of each of the plugs 1 labeled Nos. 1 to 17. Vickers hardness was measured based on JIS Z 2244 (2009). The testing force for measurement was 1 kgf.

[Test Results]

Figure 8:
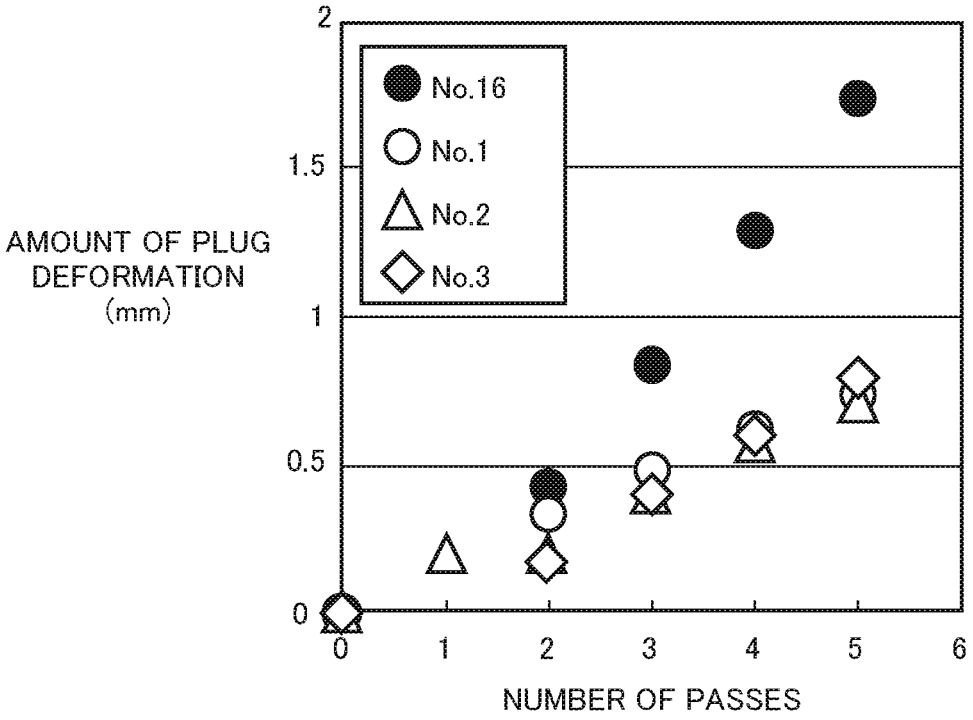
FIG. 8 is a graph showing the relationship between the amount of plug deformation and pass number.

As shown in FIG. 8, the plugs 1 labeled Nos. 1 to 3 and 16 were deformed by substantially the same amount during the first round of piercing/rolling. During the second and subsequent rounds of piercing/rolling, the plugs 1 labeled Nos. 1 to 3 were deformed by amounts smaller than the plug 1 labeled No. 16. Particularly, during the third and subsequent rounds of piercing/rolling, the plugs 1 labeled Nos. 1 to 3 were deformed by amounts about 50% smaller than the plug 1 labeled No. 16. There was no cracking in any of the plugs 1 labeled Nos. 1 to 3 and 16.

The observation of the plugs 1 labeled Nos. 1 and 16 at the cutting surfaces showed that the plug 1 labeled No. 1 had no peeling of the coating 8 due to deformation. In contrast, in the plug 1 labeled No. 16, the tip portion 2 was deformed as it was expanded horizontally and portions of the coating 8 located on the expanded portions were peeled.

Figure 9:
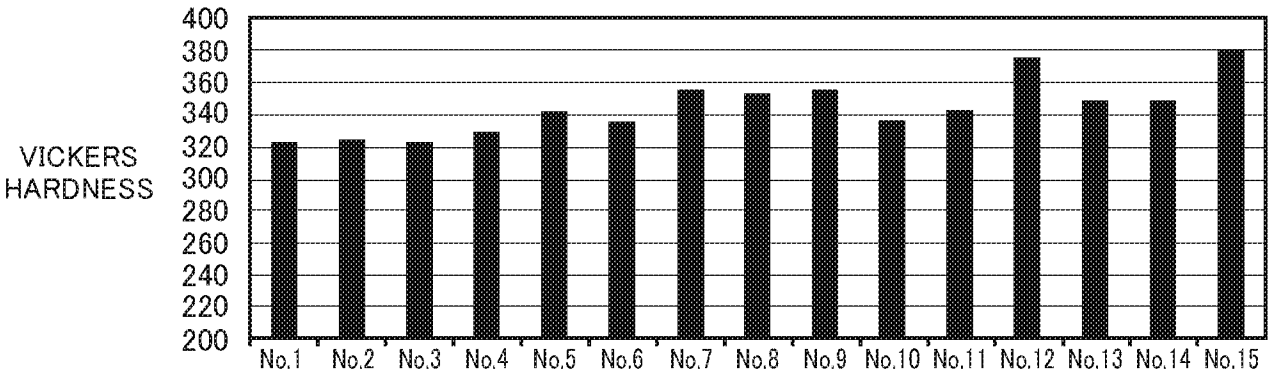
FIG. 9 is a graph showing the Vickers hardness of the tip portion of each of the piercer plugs labeled Nos. 1 to 15.

In each of the plugs 1 labeled Nos. 1 to 15, as shown in FIG. 9, the tip portion 2 had a Vickers hardness of 300 Hv or higher. Further, for these plugs 1, the higher the heating temperature, the larger the Vickers hardness tended to be. In contrast, in the plug 1 labeled No. 16, the tip portion 2 had a Vickers hardness of 250 Hv. In each of the plugs 1 labeled Nos. 1 to 16, the cylindrical portion 5 had a Vickers hardness in the range of 220 to 260 Hv.

In the plug 1 labeled No. 17, the cylindrical portion 5 had a Vickers hardness of 350 Hv. For the piercing/rolling using the plug 1 labeled No. 17, cracking was found in the cylindrical portion 5 of the plug 1 after the first round of piercing/rolling.

Although an embodiment of the present invention has been described, the above-described embodiment is merely an example for carrying out the present invention. Accordingly, the present invention is not limited to the above-described embodiment, and the above-described embodiment may be modified as appropriate without departing from the spirit of the present invention.

INDUSTRIAL APPLICABILITY

The present invention is applicable to the manufacture of seamless steel pipes.

The invention claimed is:

1. A method of manufacturing a piercer plug, the method comprising:

heating a piercer plug, the plug including a tip portion and a trunk portion made of the same material as the tip portion and continuous to the tip portion, such that a temperature of the tip portion is not lower than an austenite transformation temperature, and a temperature of a cylindrical portion included in the trunk portion and having a hole used for attaching a bar is lower than the austenite transformation temperature;

cooling the piercer plug to a temperature not higher than 400° C. at a cooling rate not lower than a cooling rate achieved by leaving the piercer plug to cool such that it provides the piercer plug with:

a Vickers hardness for the tip portion not lower than 300 Hv and not higher than 380 Hv a Vickers hardness for the cylindrical portion of 220 Hv or less, and an impact value for the cylindrical portion at 20° C. of 20 J/cm$^2$ or higher in a Charpy impact test using a full-size test specimen based on JIS Z 2242 (2005); and forming a coating on a surface of the piercer plug before the heating.

* * * * *